US007648952B2

(12) United States Patent
Lang

(10) Patent No.: US 7,648,952 B2
(45) Date of Patent: Jan. 19, 2010

(54) LIQUID DETERGENTS COMPRISING ANIONIC, NONIONIC, AND CATIONIC SURFACTANTS

(75) Inventor: Frank-Peter Lang, Hattersheim (DE)

(73) Assignee: Clariant Produkte (Deutschland) GmbH, Frankfurt (DE)

( * ) Notice: Subject to any disclaimer, the term of this patent is extended or adjusted under 35 U.S.C. 154(b) by 25 days.

(21) Appl. No.: 11/667,328

(22) PCT Filed: Nov. 5, 2005

(86) PCT No.: PCT/EP2005/011855

§ 371 (c)(1),
(2), (4) Date: Nov. 14, 2007

(87) PCT Pub. No.: WO2006/050877

PCT Pub. Date: May 18, 2006

(65) Prior Publication Data

US 2008/0090748 A1 Apr. 17, 2008

(30) Foreign Application Priority Data

Nov. 9, 2004 (DE) ..... 10 2004 053 970

(51) Int. Cl.
*C11D 1/86* (2006.01)
*C11D 1/37* (2006.01)

(52) U.S. Cl. ..... 510/352; 510/276; 510/289; 510/290; 510/316; 510/329; 510/330; 510/340; 510/341; 510/351; 510/353; 510/355; 510/357; 510/421; 510/422; 510/425; 510/426; 510/427; 510/428; 510/430; 510/432; 510/450; 510/498

(58) Field of Classification Search ..... 510/276, 510/289, 290, 316, 329, 330, 340, 341, 351, 510/352, 353, 355, 357, 421, 422, 425, 426, 510/427, 428, 430, 432, 450, 498
See application file for complete search history.

(56) References Cited

U.S. PATENT DOCUMENTS

| | | | | |
|---|---|---|---|---|
| 3,332,880 | A | 7/1967 | Kessler | |
| 4,153,570 | A | 5/1979 | Hennemann | |
| 4,507,219 | A | 3/1985 | Hughes | |
| 4,663,071 | A | 5/1987 | Bush | |
| 5,622,925 | A | 4/1997 | De Buzzaccarini | |
| 2002/0193280 | A1 * | 12/2002 | Lang et al. | 510/499 |
| 2003/0064905 | A1 * | 4/2003 | Gohl et al. | 510/352 |
| 2003/0171249 | A1 * | 9/2003 | Lang et al. | 510/528 |
| 2003/0207630 | A1 * | 11/2003 | Graham et al. | 442/118 |
| 2004/0023832 | A1 * | 2/2004 | Gallotti et al. | 510/391 |
| 2004/0204336 | A1 * | 10/2004 | Himmrich et al. | 510/504 |
| 2005/0020473 | A1 * | 1/2005 | Gallotti et al. | 510/499 |
| 2005/0164902 | A1 * | 7/2005 | Man et al. | 510/503 |
| 2005/0199272 | A1 * | 9/2005 | Levitt et al. | 134/26 |
| 2007/0277327 | A1 | 12/2007 | Wessling et al. | |

FOREIGN PATENT DOCUMENTS

| | | | |
|---|---|---|---|
| DE | 1962919 | A1 | 6/1971 |
| DE | 2530727 | A1 | 1/1977 |
| EP | 0100125 | A | 2/1984 |
| EP | 1162254 | A1 | 12/2001 |

OTHER PUBLICATIONS

English Language Machine Translation of DE2530727, Jan. 20, 1977.
English Language Machine Translation of DE1962919, Jun. 24, 1971.
English Language Abstract of JP10088187, Apr. 7, 1998.
EPO Search Report of corresponding Application No. PCT/EP/2005/011855, mailed Mar. 3, 2006.
English Translation of PCT International Preliminary Report on Patentability, mailed Aug. 30, 2007 for corresponding Application No. PCT/EP/2005/011855.
Co-pending U.S. Appl. No. 11/667,434, filed May 8, 2007.
Co-pending U.S. Appl. No. 11/667,436, filed May 8, 2007.
Co-pending U.S. Appl. No. 11/667,435, filed May 8, 2007.

* cited by examiner

*Primary Examiner*—Charles I Boyer
(74) *Attorney, Agent, or Firm*—Tod A. Waldrop

(57) ABSTRACT

A liquid washing and cleaning composition comprising:
one or more of constituents a1) through a4)
a1) alkylbenzenesulfonate,
a2) olefinsulfonate,
a3) alkylsulfate,
a4) alkyl ether sulfate or mixtures thereof,
b) secondary alkanesulfonate,
c) at least one soap,
d) at least one nonionic surfactant and
e) at least one cationic surfactant,
wherein the mixing ratio of the secondary alkanesulfonate to the component AT formed from the one or more of constituents a1, a2, a3 and a4 is 4.9 to 0.1: 5.1 to 9.9.

25 Claims, No Drawings

LIQUID DETERGENTS COMPRISING ANIONIC, NONIONIC, AND CATIONIC SURFACTANTS

The invention relates to liquid washing and cleaning compositions for textiles, which comprise anionic surfactants in combination with cationic surfactants.

In addition to the washing powders, liquid washing compositions constitute a very important product group among the washing compositions for textiles today. Liquid washing compositions comprise surfactants as a main constituent. In modern washing compositions, generally a plurality of surfactants is used simultaneously. In this context, it has been found that the combination of anionic and nonionic surfactants is useful.

Typically, the anionic surfactants used are linear alkylbenzenesulfonates (LAS), fatty alcohol sulfates (FAS), secondary alkanesulfonates (SAS), olefinsulfonates (OS) and in some cases also fatty alcohol ether sulfates (FAES). The nonionic surfactants used are ethoxylates of long-chain synthetic alcohols, for example of the oxo alcohols, or of native fatty alcohols.

As further essential constituents, builders, for example polycarboxylates, and solubilizers, for example ethanol, glycerol or propanediol, are used.

In general, additionally present in small use concentrations are additive constituents which can be summarized under the term "washing assistants" and which thus include different active substance groups such as foam regulators, graying inhibitors, soil release polymers, enzymes, optical brighteners, dye transfer inhibitors and dye fixatives.

For laundry care, so-called laundry softeners or laundry conditioners are used after the wash. These impart a pleasant soft feel to the washing, have crease-reducing action and also reduce the wear on the washing, since they reduce fiber-fiber friction. These products comprise cationic surfactants, essentially quaternary ammonium salts, for example so-called ester quats.

Unfortunately, it has to date been impossible to combine liquid washing compositions comprising anionic surfactants with cationic surfactants, in order to impart a laundry-conditioning action actually to the washing composition and thus to make the use of a softener superfluous. The reason for this lies in the lack of compatibility of the anionic surfactants with the cationic surfactants, which leads to flocculation, precipitation or phase separation of the components.

On the other hand, it is impossible to dispense with anionic surfactants when the washing composition formulation is to have very good washing capability.

However, the consumer still desires simpler laundry care, which makes the additional use of a softener superfluous.

The purpose of the present invention is to provide liquid washing and cleaning composition formulations for textiles, which comprise at least one cationic surfactant in combination with a plurality of anionic surfactants and which, in spite of the potential incompatibility of the components, are both physically and chemically stable and have both good cleaning action and softening and conditioning action.

It has now been found, surprisingly, that this aim can be achieved by a surfactant system which comprises:

1) the anionic surfactants alkylbenzenesulfonate, alkylsulfate, olefinsulfonate, alkyl ether sulfate, individually or as a mixture of two or more components, together with
2) secondary alkanesulfonate, 3) soap and 4) a nonionic surfactant.

The invention thus provides liquid washing and cleaning compositions comprising a1) alkylbenzenesulfonate,
a2) olefinsulfonate,
a3) alkylsulfate,
a4) alkyl ether sulfate or mixtures thereof,
b) secondary alkanesulfonate,
c) soap,
d) nonionic surfactant and e) cationic surfactant.

The individual components are described below:

a1) Alkylbenzenesulfonate

The alkyl group may be branched or linear and may optionally be substituted by a hydroxyl group or be unsaturated (=alkenyl). The preferred alkylbenzenesulfonates contain linear alkyl chains having from approx. 9 to 25 carbon atoms, preferably from approx. 10 to approx. 13 carbon atoms; the cation is sodium, potassium, ammonium, mono-, di- or triethanolammonium, calcium or magnesium, and mixtures thereof.

For mild surfactant systems, magnesium is preferred as the cation; for standard washing applications, in contrast, sodium.

a2) Olefinsulfonates

These are obtained by sulfonating $C_8$-$C_{24}$-α-olefins, preferably $C_{14}$-$C_{16}$-α-olefins, with sulfur trioxide and subsequently neutralizing.

As a result of the preparation process, these olefinsulfonates may contain relatively small amounts of hydroxyalkanesulfonates and alkanedisulfonates. Specific mixtures of α-olefinsulfonates are described in U.S. Pat. No. 3,332,880.

a3) Alkylsulfates

These are water-soluble salts or acids of the formula $ROSO_3M$ in which R is a $C_{10}$-$C_{24}$-hydrocarbon radical, preferably a $C_{10}$-$C_{20}$-alkyl or -hydroxyalkyl radical, more preferably a $C_{12}$-$C_{18}$-alkyl or -hydroxyalkyl radical.

M is hydrogen or a cation, for example an alkali metal cation (e.g. sodium, potassium, lithium) or ammonium or substituted ammonium, for example methyl-, dimethyl- and trimethylammonium cations, alkanolammonium, for example triethanolammonium and quaternary ammonium cations such as tetramethylammonium and dimethylpiperidinium cations, and quaternary ammonium cations derived from alkylamines such as ethylamine, diethylamine, triethylamine and mixtures thereof.

Alkyl chains of $C_{12}$-$C_{16}$ are preferred for low washing temperatures (for example below approx. 50° C.) and alkyl chains of $C_{16}$-$C_{18}$ for higher washing temperatures (for example above approx. 50° C.).

a4) Alkyl Ether Sulfates

These are water-soluble salts or acids of the formula $RO(A)_m\ SO_3M$, in which R is an unsubstituted $C_{10}$-$C_{24}$-alkyl or -hydroxyalkyl radical, preferably a $C_{12}$-$C_{20}$-alkyl or -hydroxyalkyl radical, more preferably $C_{12}$-$C_{18}$-alkyl or -hydroxyalkyl radical.

A is an ethoxy or propoxy unit, m is an integer greater than 0, preferably between approx. 0.5 and approx. 6, more preferably between approx. 0.5 and approx. 3, and M is a hydrogen atom or a cation, for example sodium, potassium, lithium, calcium, magnesium, ammonium or a substituted ammonium cation. Specific examples of substituted ammonium cations are methyl-, dimethyl-, trimethylammonium and quaternary ammonium cations such as tetramethylammonium and dimethylpiperidinium cations, and also those which are derived from alkylamines such as ethylamine, diethylamine, triethylamine or mixtures thereof. Examples include $C_{12}$-$C_{18}$ fatty alcohol ether sulfates where the content of EO is 1, 2, 2.5, 3 or 4 mol per mole of the fatty alcohol ether sulfate, and in which M is sodium or potassium. Owing to their high evolution of foam, the use concentration of the alkyl ether sulfates depends upon their use. Lower concentrations are used in washing compositions for machine washing than in washing compositions for manual washing.

Components a1, a2, a3 and a4 are used, individually or in any combination with one another, in concentrations totaling from 1 to 40% by weight, preferably from 5 to 30% by weight, more preferably from 5 to 25% by weight and most preferably from 6 to 20% by weight, based on the finished washing and cleaning composition. They form the component AT in the inventive washing and cleaning compositions.

b) Secondary Alkanesulfonates

In secondary alkanesulfonates, the alkyl group may either be saturated or unsaturated, may be branched or linear and may optionally be substituted by a hydroxyl group. The sulfo group may be at any position in the carbon chain, but the primary methyl groups at the start and end of the chain do not have any sulfonate groups. The preferred secondary alkanesulfonates contain linear alkyl chains having from approx. 9 to 25 carbon atoms, preferably from approx. 10 to 20 carbon atoms and more preferably from approx. 13 to 17 carbon atoms. The cation is, for example, sodium, potassium, ammonium, mono-, di- or triethanolammonium, calcium or magnesium. It is also possible to use mixtures of different cations.

Very particular preference is given to secondary $C_{13-17}$-alkanesulfonate, sodium salt, which is obtainable, for example, under the trade names Hostapur® SAS (Clariant), Leuna alkanesulfonate or emulsifier E30 (Leuna-Tenside GmbH) or Marlon® PS (Sasol).

Secondary alkanesulfonates are used in addition to component AT. The mixing ratio of sec. alkanesulfonate:AT is generally at least 9.9:0.1, preferably 9.8 to 5:0.2 to 5, more preferably 4.9 to 0.1:5.1 to 9.9.

c) Soap

Soap comprises the salts of long-chain native fatty acids having from 10 to 20 carbon atoms. The fatty acid used for soaps in liquid washing compositions is in particular coconut fatty acid, which constitutes mainly a mixture of $C_{12}$ and $C_{14}$ fatty acid. However, it is also possible to use longer-chain fatty acids such as oleic acid, soybean fatty acid, tallow fatty acid, stearic acid, behenic acid or mixtures thereof. It is possible to use the fatty acids as soaps in the form of their sodium, potassium, ammonium, mono-, di- or triethanolammonium salts.

For liquid washing compositions, particular preference is given to the potassium, ammonium, mono-, di- or triethanolammonium salts of coconut fatty acid, of soybean fatty acid, of oleic acid and of mixtures thereof with one another or optionally with other fatty acids.

In the inventive liquid washing and cleaning compositions, soap is used generally to an extent of from 1 to 30% by weight, preferably from 3 to 25% by weight and more preferably from 5 to 20% by weight.

d) Nonionic Surfactants

Useful nonionic surfactants include in particular the ethoxylates of long-chain, aliphatic, synthetic or native alcohols having a $C_8$- to $C_{22}$-alkyl radical. These may contain from approx. 1 to approx. 25 mol of ethylene oxide.

The alkyl chain of the aliphatic alcohols may be linear or branched, primary or secondary, saturated or else unsaturated.

Preference is given to the condensation products of $C_{10}$- to $C_{18}$-alcohols with from approx. 2 to approx. 18 mol of ethylene oxide per mole of alcohol. The alcohol ethoxylates may have a narrow homolog distribution ("narrow range ethoxylates") or a broad homolog distribution of the ethylene oxide ("broad range ethoxylates"). Particular preference is given to the $C_9$-$C_{11}$ oxo alcohol with from 6 to 10 mol of EO and the $C_{12/C14}$ fatty alcohol with from 5 to 9 mol of EO. Very particular preference is given to $C_{11}$ oxo alcohol-8EO ethoxylate and $C_{12/14}$ fatty alcohol-7EO ethoxylate. In general, preference is given to those nonionic surfactants which have an HLB value of from 10 to 15, more preferably from 11 to 14.

The use concentration is generally from 5 to 35% by weight, preferably from 10 to 30% by weight, more preferably from 15 to 25% by weight and most preferably from 16 to 23% by weight.

e) Cationic Surfactants

The cationic surfactants mentioned below are preferably present as the chlorides or bromides, but may also be used as the methosulfates.

Suitable cationic surfactants are, for example, quaternary ammonium salts such as di($C_8$-$C_{24}$)alkyldimethylammonium chloride or bromide, preferably di($C_{12}$-$C_{18}$)alkyldimethylammonium chloride or bromide, for example distearyidimethylammonium chloride or bromide, ditallowalkyldimethylammonium chloride or bromide, dioleyldimethylammonium chloride or bromide, dicocoalkyldimethylammonium chloride or bromide; ($C_8$-$C_{24}$)alkyldimethylethyl-ammonium chloride or bromide; ($C_8$-$C_{24}$)alkyltrimethylammonium chloride or bromide, preferably cetyltrimethylammonium chloride or bromide, and ($C_{20}$-$C_{22}$)alkyltrimethylammonium chloride or bromide; ($C_8$-$C_{24}$)alkyldimethylbenzyl-ammonium chloride or bromide, preferably ($C_{12}$-$C_{18}$)alkyldimethylbenzyl-ammonium chloride; N—($C_{10}$-$C_{18}$)alkylpyridinium chloride or bromide, preferably N—($C_{12}$-$C_{16}$) alkylpyridinium chloride or bromide; N—($C_{10}$-$C_{18}$) alkylisoquinolinium chloride, bromide or monoalkylsulfate; N—($C_{12}$-$C_{18}$)alkylpolyoylaminoformylmethyl-pyridinium chloride; N—($C_{12}$-$C_{18}$)alkyl-N-methylmorpholinium chloride, bromide or monoalkylsulfate; N—($C_{12}$-$C_{18}$)alkyl-N-ethylmorpholinium chloride, bromide or monoalkylsulfate; ($C_{16}$-$C_{18}$)alkylpentaoxethylammonium chloride; diisobutylphenoxyethoxyethyldimethylbenzylammonium chloride; salts of N,N-diethylaminoethylstearylamide and -oleylamide with hydrochloric acid, acetic acid, lactic acid, citric acid, phosphoric acid; N-acylaminoethyl-N,N-diethyl-N-methylammonium chloride, bromide or monoalkylsulfate and N-acylaminoethyl-N,N-diethyl-N-benzylammonium chloride, bromide or monoalkylsulfate, where acyl is preferably stearyl or oleyl.

A particularly preferred class of cationic surfactants is that of the so-called ester quats, for example the triethanolamine diester quat and the diethanol/methylamine diester quat. These are prepared starting from triethanolamine or diethanol/methylamine by esterifying the amines with from one to two mol (in the case of triethanolamine up to three mol), preferably with two mol, of a fatty acid, and then quaternizing with methyl chloride, methyl bromide or with dimethyl sulfate. The fatty acids used for the esterification are $C_8$-$C_{24}$ fatty acids, which may be saturated or unsaturated, for example stearic acid, tallow fatty acid (also partially hydrogenated), coconut fatty acid and oleic acid.

Further preferred cationic surfactants for washing compositions are alkylhydroxyethylammonium salts of the formula

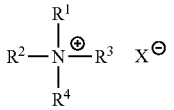

(1)

where $R^1$ is a linear or branched, saturated or unsaturated alkyl group having from 5 to 22 carbon atoms, preferably from 8 to 18 carbon atoms, more preferably from 12 to 14 carbon atoms, $R^2$ is a methyl group, $R^3$ is a methyl group or a group of the formula -A-(OA)n-OH where A may be a —$C_2H_4$— and/or —$C_3H_6$— group and n may be from 0 to 20, $R^4$ is a group of the formula -A-(OA)n-OH and X is anion; X is, for example, chloride, bromide, iodide, fluoride, sulfate, hydrogensulfate, carbonate, hydrogencarbonate, acetate, citrate, phosphate, mono- and dihydrogenphosphate, pyrophosphate, polyphosphate, metaphosphate, nitrate, methylsulfate, phosphonate, methylphosphonate, methanedisulfonate, methylsulfonate, ethanesulfonate or an anion of the formula $R^6SO_3$, $R^7SO_4$ or $R^6COO$, in which $R^6$ and $R^7$ are each $C_2$-$C_{20}$-alkyl, preferably $C_{10}$-$C_{18}$-alkyl, and $R^7$ is additionally also $C_1$-$C_{18}$-alkylphenyl.

As the compound of the formula (1), particular preference is given to quaternary $C_{12}$-$C_{14}$-alkyldimethylhydroxyethylammonium chloride or methosulfate.

The proportion by weight of the cationic surfactants in the inventive liquid washing compositions is typically from 0.1 to 10% by weight, preferably from 0.5 to 8% by weight, more preferably from 1 to 6% by weight and most preferably from 2 to 5% by weight.

The inventive liquid washing compositions are preferably liquid and clear and have a viscosity up to approx. 500 mPas. However, they may also have a higher viscosity, or be still free-flowing gels or spreadable pastes. In addition to clear formulations, opaque or cloudy formulations are also possible.

In a particularly preferred embodiment, the inventive washing and cleaning compositions additionally comprise, as solvents, propanediol, glycerol, ethanol, n-propanol or isopropanol in concentrations of from 1 to 10% by weight, preferably from 1 to 5% by weight.

In a further particularly preferred embodiment, the pH of the formulations is adjusted to a value between 5 and 12 by the addition of acidic or alkaline substances. Acidic substances may, for example, be inorganic or organic acids, for example sulfuric acid, phosphonic acids, citric acid. Alkaline substances are, for example, sodium hydroxide solution, potassium hydroxide solution, sodium carbonate and ethanolamines.

Acidic to neutral liquid washing compositions are, for example, wool washing compositions, neutral to weakly alkaline liquid washing compositions are, for example, mild-action washing compositions, and alkaline washing compositions are so-called heavy duty washing compositions.

Liquid washing and cleaning compositions which comprise the inventive surfactant combination may additionally comprise further constituents as are customary in such compositions. These will be described below. The total surfactant content of the inventive washing composition formulations may be from 10 to 70% by weight, preferably from 10 to 55% by weight and most preferably from 20 to 50% by weight.

Further Anionic Surfactants

Useful further anionic surfactants include sulfates, sulfonates, carboxylates, phosphates and mixtures thereof. Suitable cations here are alkali metals, for example sodium or potassium, or alkaline earth metals, for example calcium or magnesium, and also ammonium, substituted ammonium compounds, including mono-, di- or triethanolammonium cations and mixtures thereof.

The following types of anionic surfactants are particularly preferred:

Alkyl ester sulfonates include linear esters of $C_8$-$C_{20}$-carboxylic acids (i.e. fatty acids) which are sulfonated by means of gaseous $SO_3$.

Suitable starting materials are natural fats, such as tallow, coconut oil and palm oil, but may also be of synthetic nature.

Preferred alkyl ester sulfonates, especially for washing composition applications, are compounds of the formula

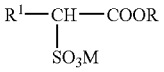

in which $R^1$ is a $C_8$-$C_{20}$-hydrocarbyl radical, preferably alkyl, and R is a $C_1$-$C_6$-hydrocarbyl radical, preferably alkyl. M is a cation which forms a water-soluble salt with the alkyl ester sulfonate. Suitable cations are sodium, potassium, lithium or ammonium cations, for example monoethanolamine, diethanolamine and triethanolamine. Preferably, $R^1$ is $C_{10}$-$C_{16}$-alkyl and R is methyl, ethyl or isopropyl. Most preferred are methyl ester sulfonates in which $R^1$ is $C_{10}$-$C_{16}$-alkyl.

In addition to secondary alkanesulfonates, it is also possible to use primary alkanesulfonates in the inventive washing compositions. The preferred alkyl chains and cations correspond to those of the secondary alkanesulfonates.

Further useful anionic surfactants include salts of acylaminocarboxylic acids; the acyl sarcosinates which are formed by reacting fatty acid chlorides with sodium sarcosinate in an alkaline medium; fatty acid/protein condensation products which are obtained by reacting fatty acid chlorides with oligopeptides; salts of alkylsulfamidocarboxylic acids; alkyl glyceryl sulfates and alkenyl glyceryl sulfates, such as oleyl glyceryl sulfates; alkylphenol ether sulfates; alkyl phosphates; alkyl ether phosphates; isethionates, such as acyl isethionates; N-acyltaurides; alkyl succinates; sulfosuccinates; monoesters of sulfosuccinates (particularly saturated and unsaturated $C_{12}$-$C_{18}$ monoesters) and diesters of sulfosuccinates (particularly saturated and unsaturated $C_{12}$-$C_{18}$ diesters); acyl sarcosinates; sulfates of alkylpolysaccharides, such as sulfates of alkylpolyglycosides, and branched primary alkyl sulfates.

Nonionic surfactants which can be used in addition to those mentioned at the outset.

Condensation products of ethylene oxide with a hydrophobic base, formed by condensation of propylene oxide with propylene glycol.

The hydrophobic moiety of these compounds preferably has a molecular weight from approx. 1500 to approx. 1800. The addition of ethylene oxide onto this hydrophobic moiety leads to an improvement in the water solubility. The product is liquid up to a polyoxyethylene content of approx. 50% of the total weight of the condensation product, which corresponds to a condensation with up to approx. 40 mol of ethylene oxide. Commercially available examples of this product class are, for example, the Pluronic® brands of BASF and the ®Genapol brands of Clariant GmbH.

Condensation products of ethylene oxide with a reaction product of propylene oxide and ethylenediamine.

The hydrophobic unit of these compounds consists of the reaction product of ethylenediamine with excess propylene oxide and generally has a molecular weight of from approx. 2500 to 3000. Ethylene oxide is added onto this hydrophobic unit until the product has a content of from approx. 40 to approx. 80% by weight of polyoxyethylene and a molecular weight of from approx. 5000 to 11 000. Commercially available examples of this compound class are, for example, the Tetronic® brands from BASF and the ®Genapol PN brands of Clariant GmbH.

Polyethylene oxide, polypropylene oxide and polybutylene oxide condensates of alkylphenols.

These compounds include the condensation products of alkylphenols having a $C_6$-$C_{20}$-alkyl group, which may be linear or branched, with alkene oxides. Preference is given to compounds having from approx. 5 to 25 mol of alkene oxide per mole of alkylphenol. Commercially available surfactants of this type are, for example, Igepal® CO-630, Triton® X-45, X-114, X-100 and X102, and the ®Arkopal-N brands of Clariant GmbH. These surfactants are referred to as alkylphenol alkoxylates, for example alkylphenol ethoxylates.

Semipolar Nonionic Surfactants

This category of nonionic compounds comprises water-soluble amine oxides, water-soluble phosphine oxides and water-soluble sulfoxides, each having an alkyl radical of from approx. 8 to approx. 18 carbon atoms. Semipolar nonionic surfactants are also amine oxides of the formula

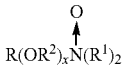

where R is an alkyl, hydroxyalkyl or alkylphenol group with a chain length of from approx. 8 to approx. 22 carbon atoms. $R^2$ is an alkylene or hydroxyalkylene group having from approx. 2 to 3 carbon atoms or mixtures thereof, each radical $R^1$ is an alkyl or hydroxyalkyl group having from approx. 1 to approx. 3 carbon atoms or a polyethylene oxide group having about 1 to about 3 ethylene oxide units, and x is a number from 0 to about 10. The $R^1$ groups may be joined together via an oxygen or nitrogen atom and thus form a ring.

Particularly preferred amine oxides are $C_8$-$C_{18}$-alkyldimethylamine oxides and $C_8$-$C_{12}$-alkoxyethyldihydroxyethylamine oxides and $C_8$-$C_{15}$ fatty acid amidoalkyl-dimethylamine oxides. Amine oxides may be used in use concentrations of from 0.5 to 10% by weight and preferably from 1 to 5% by weight.

Fatty Acid Amides

Fatty acid amides have the formula

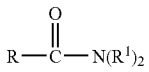

in which R is an alkyl group having from approx. 7 to approx. 21, preferably from approx. 9 to approx. 17, carbon atoms, and $R^1$ is in each case independently hydrogen, $C_1$-$C_4$-alkyl, $C_1$-$C_4$-hydroxyalkyl or $(C_2H_4O)_xH$ where x varies from about 1 to about 3. Preference is given to $C_8$-$C_{20}$ amides, in particular the corresponding monoethanolamides, diethanolamides and isopropanolamides. These may be used in concentrations of from 0.5 to 5% by weight and in particular from 0.5 to 3% by weight.

Further suitable nonionic surfactants are alkyl- and alkenyloligoglycosides, and also fatty acid polyglycol esters or fatty amine polyglycol esters each having from 8 to 20, preferably from 12 to 18, carbon atoms in the fatty alkyl radical, alkoxylated triglycamides, mixed ethers or mixed formyls, alkyloligoglycosides, alkenyloligoglycosides, fatty acid N-alkylglucamides, phosphine oxides, dialkyl sulfoxides and protein hydrolyzates.

Zwitterionic Surfactants

Typical examples of amphoteric or zwitterionic surfactants are carbobetaines, sulfobetaines, aminoglycinates or amphoteric imidazolinium compounds.

Zwitterionic surfactants preferred for use in the inventive liquid washing compositions are the carboxymethylammoniobetaines, especially $C_8$- to $C_{18}$-alkyldimethylcarboxymethylammoniobetaines, $C_8$- to $C_{18}$-alkylamidopropyl-dimethylcarboxymethylammoniobetaines and $C_8$- to $C_{18}$-alkyldipolyethoxycarboxy-methylammoniobetaines.

Further betaines are, for example, the N-carboxyethylammoniobetaines analogous to the compounds detailed above, for whose synthesis chloropropionic acid and its salts are used in place of chloroacetic acid and its salts. The examples thereof are the $C_{12}$-$C_{18}$-alkylaminopropionates and $C_{12}$-$C_{18}$-alkyliminodipropionates as the alkali metal and mono-, di- and trialkylammonium salts. A preferred sulfobetaine is $C_{12}$-$C_{18}$-alkyldimethylsulfopropylbetaine.

Amphosurfactants based on imidazoline are supplied under the trade names Miranol® and Steinapon®. Preference is given to the sodium salt of 1-(carboxymethyloxyethyl)-1-(carboxymethyl)-2-laurylimidazolinium. The zwitterionic surfactants are used as cosurfactants. Their use concentration is from 1 to 10% by weight, preferably from 3 to 5% by weight.

Further washing composition ingredients which may be present in the present invention include inorganic and/or organic builders in order to reduce the hardness of the water.

Inorganic builders comprise, for example, alkali metal, ammonium and alkanolammonium salts of polyphosphates, for instance tripolyphosphates, pyrophosphates and glasslike polymeric metaphosphates, phosphonates, silicates, carbonates including bicarbonates and sesquicarbonates, and aluminosilicates, as described below:

Aluminosilicate builders, especially zeolites having the formula $Na_z[(AlO_2)_z(SiO_2)_y].xH_2O$ where z and y are integers of at least 6, the ratio of z to y is from 1.0 to about 0.5, and x is an integer from about 15 to about 264. Suitable ion exchangers based on aluminosilicate are commercially available. These aluminosilicates may be of crystalline or amorphous structure, and may be naturally occurring or else synthetically produced. Preferred ion exchangers based on synthetic crystalline aluminosilicates are obtainable under the name Zeolite A, Zeolite P(B) and Zeolite X. Preference is given to aluminosilicates having a particle diameter between 0.1 and 10 μm.

Suitable organic builders include polycarboxyl compounds, for example ether polycarboxylates and oxydisuccinates. Reference should likewise be made to "TMS/TDS" builders from U.S. Pat. No. 4,663,071.

Other suitable builders include the ether hydroxypolycarboxylates, copolymers of maleic anhydride with ethylene or vinyl methyl ether, 1,3,5-trihydroxybenzene-2,4,6-trisulfonic acid and carboxymethyloxysuccinic acid, the alkali metal, ammonium and substituted ammonium salts of poly-acetic acids, for example ethylenediaminetetraacetic acid and nitrilotriacetic acid, and also polycarboxylic acids such as mellitic acid, succinic acid, oxydisuccinic acid, polymaleic acid, benzene-1,3,5-tricarboxylic acid, carboxymethyloxysuccinic acid, and soluble salts thereof.

Preferred organic builders are also polycarboxylates based on acrylic acid and/or maleic acid, for example the Sokalan CP brands (BASF) or the Acusol brands (Rohm and Haas), and also builders based on citrate, for example citric acid and its soluble salts, especially the sodium salt.

Further suitable builders are the 3,3-dicarboxy-4-oxa-1,6-hexanedioates and the related compounds. Builders based on phosphonis are alkali metal phosphates, for instance sodium tripoliphosphate, sodium pyrophosphate and sodium orthophosphate.

Preferred builders for the present invention are phosphonates, such as ethane-1-hydroxy-1,1-diphosphonate (HEDP) and other known phosphonates. The inventive liquid washing compositions may further comprise the customary assistants which enhance the cleaning action, serve for the care of the textile to be washed or alter the use properties of the washing composition.

Suitable assistants are, for example enzymes, especially proteases, lipases, cellulases, amylases and mannanases; enzyme stabilizers; foam enhancers; foam inhibitors such as silicone oils or paraffins; corrosion inhibitors; dye transfer inhibitors; dye fixatives; optical brighteners; UV absorbers; bleaches; preservatives; alkalis; hydrotropic compounds; antioxidants; solvents and solubilizers, such as ethanol, propanol, glycerol, propanediol; dispersants, antiredeposition agents; graying inhibitors; softeners; antistats; dyes and perfumes.

Dyes

The term dyes here encompasses both water-soluble dyes and insoluble chromatic pigments. Water-soluble dyes are, though, used with preference in liquid washing compositions. These include the groups of the acid dyes, direct dyes and reactive dyes. It is possible to assign, for example, representatives of the azo dyes, metal complex dyes and the polycyclic dyes to these groups.

Perfume Oils and Odorants

The fragrance and perfume oils used may be individual odorant compounds, for example the synthetic products of the ester, ether, aldehyde, ketone, alcohol and hydrocarbon type. Preference is given to using mixtures of different odorants which together generate a pleasing fragrance note.

Perfume oils may also comprise natural odorant mixtures and essential oils of low volatility.

Optical Brighteners

These include in particular the brighteners of the diaminostilbene and distyrylbiphenyl type.

Dye Transfer Inhibitors

These include polyamine N-oxides, for instance poly(4-vinylpyridine N-oxide), poly(4-vinylpyridine betaine), polyvinylpyrrolidone and copolymers of N-vinylpyrrolidone with N-vinylimidazole and optionally other monomers, polyvinylimidazole, and also cyclodextrins and cyclodextrin derivatives.

e) Dye Fixatives

The dye fixatives which may be incorporated into inventive liquid washing compositions are nonionic or cationic and are described below:

Polycondensates which may be used as dye fixatives are obtained by the reaction of cyanamides with aldehydes and ammonium salts and/or monoamines, by the reaction of monoamines and/or polyamines with epichlorohydrin or by the reaction of polyamines with cyanamides and amidosulfuric acid.

The dye fixatives used may also be homo- and copolymers based on diallyldimethylammonium chloride (DADMAC).

Copolymers based on DADMAC contain, as a further component, other vinylic monomers, for example vinylimidazole, vinylpyrrolidone, vinyl alcohol, vinyl acetate, (meth)acrylic acid/esters, acrylamide, styrene, styrenesulfonic acid, acrylamidomethylpropanesulfonic acid (AMPS), etc.

Homopolymers based on DADMAC are obtainable under the trade names Dodigen® 3954, Dodigen 4033 and Genamin® (from Clariant).

The dye fixatives may be present in liquid washing compositions to an extent of from 0.25 to 5% by weight, preferably to an extent of from 0.5 to 3% by weight and more preferably to an extent of from 0.5 to 1% by weight.

The inventive formulations are notable in that they are stable and do not flake. In addition to the softening effect owing to the presence of cationic surfactants, they also bring about an anticrease effect and protection from mechanical wear.

The invention claimed is:

1. A clear liquid textile washing and cleaning composition comprising:

one or more of the following constituents a1) through a4):

a1) alkylbenzenesulfonate, a2) olefinsulfonate, a3) alkylsulfate, a4) alkyl ether sulfate, b) secondary alkanesulfonate, c) from 1 to 30% of at least one soap, d) from 5 to 35% of at least one nonionic surfactant, and e) from 0.1 to 10% of at least one cationic surfactant, wherein the mass ratio of the anionic surfactants to the at least one nonionic surfactant is from 0.8:1 to 1.5:1, and the mixing ratio of the secondary alkanesulfonate to the component AT formed from the one or more of constituents a1, a2, a3 and a4 is 4.9 to 0.1: 5.1 to 9.9.

2. The washing and cleaning composition as claimed in claim 1, comprising the one or more constituents a1, a2, a3 and a4, individually or in any combination with one another, in concentrations of from 1 to 40% by weight.

3. The washing and cleaning composition as claimed in claim 1, wherein the at least one nonionic surfactant is an ethoxylate of a synthetic or native alcohol having an HLB value of from 10 to 15.

4. The washing and cleaning composition as claimed in claim 1, wherein the content of the at least one cationic surfactant and at least one nonionic surfactant, combined, is between 10 to 70% by weight.

5. The washing and cleaning composition as claimed in claim 1, further comprising propanediol, glycerol, ethanol, n-propanol or isopropanol in an amount of from 1 to 10% by weight.

6. The washing and cleaning composition as claimed in claim 1, having a pH between 5 and 12.

7. A process for increasing the anticrease effect in a textile comprising the step of treating the textile with a washing and cleaning composition as claimed in claim 1.

8. A process for protecting a textile from mechanical wear comprising the step of treating the textile with a washing and cleaning composition as claimed in claim 1.

9. The washing and cleaning composition as claimed in claim 1, comprising the one or more constituents a1, a2, a3 and a4, individually or in any combination with one another, in concentrations of from 5 to 30% by weight.

10. The washing and cleaning composition as claimed in claim 1, comprising the one or more constituents a1, a2, a3 and a4, individually or in any combination with one another, in concentrations of from 5 to 25% by weight.

11. The washing and cleaning composition as claimed in claim 1, comprising the one or more constituents a1, a2, a3 and a4, individually or in any combination with one another, in concentrations of from 6 to 20% by weight.

12. The washing and cleaning composition as claimed in claim 1, comprising from 3 to 25% by weight of the at least one soap.

13. The washing and cleaning composition as claimed in claim 1, comprising from 5 to 20% by weight of the at least one soap.

14. The washing and cleaning composition as claimed in claim 1, comprising from 10 to 30% by weight of the at least one nonionic surfactant.

15. The washing and cleaning composition as claimed in claim 1, comprising from 15 to 25% by weight of the at least one nonionic surfactant.

16. The washing and cleaning composition as claimed in claim 1, comprising from 16 to 23% by weight of the at least one nonionic surfactant.

17. The washing and cleaning composition as claimed in claim 1, wherein the nonionic surfactant is an ethoxylate of a synthetic or native alcohol having an HLB value of from 11 to 14.

18. The washing and cleaning composition as claimed in claim 1, comprising from 0.5 to 8% by weight of the at least one cationic surfactant.

19. The washing and cleaning composition as claimed in claim 1, comprising from 1 to 6% by weight of the at least one cationic surfactant.

20. The washing and cleaning composition as claimed in claim 1, comprising from 2 to 5% by weight of the at least one cationic surfactant.

21. The washing and cleaning composition as claimed in claim 1, wherein the content of the at least one cationic surfactant and at least one nonionic surfactant, combined, is between 10 to 45% by weight.

22. The washing and cleaning composition as claimed in claim 1, wherein the content of the at least one cationic surfactant and at least one nonionic surfactant, combined, is between 20 to 45% by weight.

23. The washing and cleaning composition as claimed in claim 1, further comprising propanediol, glycerol, ethanol, n-propanol or isopropanol in an amount of from 1 to 5% by weight.

24. A textile having an anticrease effect treated in accordance with the process of claim 7.

25. A textile protected from mechanical wear treated in accordance with the process of claim 8.

* * * * *